US005853546A

United States Patent [19]

Graf

[11] Patent Number: 5,853,546

[45] Date of Patent: Dec. 29, 1998

[54] SEALED TITANIUM SLICE LIP FOR A HEADBOX

[75] Inventor: Edwin X. Graf, Menasha, Wis.

[73] Assignee: Voith Sulzer Paper Technology North America, Inc., Appleton, Wis.

[21] Appl. No.: 915,813

[22] Filed: Aug. 21, 1997

[51] Int. Cl.[6] ..... D21F 1/02

[52] U.S. Cl. ..... 162/344; 162/336

[58] Field of Search ..... 162/336, 344, 162/347

[56] References Cited

U.S. PATENT DOCUMENTS

| | | | |
|---|---|---|---|
| 4,124,441 | 11/1978 | Nykopp | 162/353 |
| 4,280,870 | 7/1981 | Bubik et al. | 162/347 |
| 4,620,899 | 11/1986 | Wolf | 162/344 |
| 4,731,163 | 3/1988 | Ilmoniemi | 162/344 |
| 4,792,380 | 12/1988 | Tuomikoski | 162/344 |
| 5,271,807 | 12/1993 | Kinzler | 162/262 |
| 5,284,551 | 2/1994 | Beran et al. | 162/353 |

FOREIGN PATENT DOCUMENTS

| | | | |
|---|---|---|---|
| 3535849 | 4/1987 | Germany | 162/344 |
| 679926 | 9/1952 | United Kingdom | 162/344 |

OTHER PUBLICATIONS

K. A. Cutshall and R. G. Hamel; Slice Lip Automation, Pulp Paper Canada, 1988.

Bradford C. Garnett, Measurex Corporation; Gaining an Edge: CD Profile Control at the Headbox PIMA, Feb. 1984.

The Condensed Chemical Dictionary, Gessner G. Hawley, 1981, p. 1026.

*Primary Examiner*—Karen M. Hastings

*Attorney, Agent, or Firm*—Taylor & Associates, P.C.

[57] ABSTRACT

A headbox for a paper-making machine includes an inlet for receiving a fiber suspension and an outlet for discharging the fiber suspension. The headbox has a plurality of walls including an apron and a pair of side plates. The side plates are disposed at opposite ends of the headbox. The apron is comprised of steel. A beam extends between the side plates and includes opposite ends. Each end is disposed a predetermined distance from a respective side plate when at an ambient temperature (approximately 70° F.). The beam is comprised of steel. A slice lip is carried by the beam. The slice lip is positioned at the outlet and includes a working edge defining an outlet gap with the apron. The slice lip has a pair of longitudinal ends, with each longitudinal end being disposed a predetermined distance from a respective side plate when at the ambient temperature. Each longitudinal end includes a slot extending from and substantially orthogonal to the edge. The slice lip consists essentially of titanium. A pair of seals are disposed in respective ones of the slots and seal between a respective longitudinal end of the slice lip and a respective side plate. Each seal is comprised of a non-woven, porous material.

14 Claims, 2 Drawing Sheets

SEALED TITANIUM SLICE LIP FOR A HEADBOX

BACKGROUND OF THE INVENTION

1. Field of the Invention

The present invention relates to paper-making machinery, and, more particularly, to a headbox having a titanium slice lip.

2. Description of the Related Art

Paper-making machines typically include a headbox, including an inlet for receiving a fiber suspension and an outlet gap for discharging the fiber suspension with a known cross sectional profile onto a wire or forming fabric carried by a plurality of rolls. A slice lip is disposed at the outlet gap and is adjustable in a direction transverse to the outlet gap to thereby vary the outlet gap and control the discharge of the fiber suspension therefrom. A plurality of drive spindle assemblies may be spaced along the working length of the slice lip and deflect the slice lip in a direction transverse to the working edge. The slice lip may include a plurality of elongate openings extending downwardly from the top edge and in a direction transverse to the working edge of the slice lip for allowing increased local deformations of the slice lip by the drive spindle assemblies.

With conventional designs, the slice lip is typically formed from steel or a steel alloy. However, it is also known to form the slice lip from titanium rather than steel because of superior flexibility properties of titanium during the deflections and deformations of the slice lip discussed above. The titanium slice lip is carried by a parallel steel beam. The slice lip and steel beam are bounded on either end by side plates or "pond sides" of the headbox.

A problem with mounting a titanium slice lip on a steel beam is that the coefficient of thermal expansion is lower for titanium (about $4.7\times10^{-6}$ inch/[inch °F.]) than for steel (about $8.9\times10^{-6}$ inch/[inch °F.]). At room temperature (approximately 70° F.), the opposing ends of the titanium slice lip and steel beam are substantially flush with each other and disposed at a distance of approximately 0.005 inch from the side plates of the headbox. Generally speaking, it is desirable to maintain a gap headbox exposed to the fiber suspension flow. If gaps larger than 0.005 inch exist, chemical and biological buildup may occur at the gaps, thereby resulting in the formation of "strings" within the fiber suspension. The formation of strings within the fiber suspension typically begins as the result of a deposit of fibers within a gap exposed to the fiber suspension flow having a dimension of greater than approximately 0.005 inch. During operation, the steel beam and slice lip expand at different rates because of the approximate 2:1 ratio in the respective coefficients of thermal expansion. Since the headbox, including the side plates and the apron adjacent the slice lip, is also typically formed of stainless steel, the apron expands at approximately the same rate as the steel beam and the desired clearance of approximately 0.005 inch is maintained between the steel beam and the side plates. On the other hand, the titanium slice lip expands at a rate which is approximately only ½ that of the steel beam. The longer the slice lip, the larger the differential expansion between the steel beam and the slice lip. For example, with a slice lip of approximately 400 inches, the difference in longitudinal expansion as the slice lip rises from 70° F. to 160° F. is approximately 0.076 inch per longitudinal end. This results in a gap between each end of the titanium slice lip and the side plates of approximately 0.080 inch, well above the desired gap of 0.005 inch.

Additionally, the formation of such a large gap between the end of the slice lip and the side plates of the headbox results in the formation of "rooster tails" as the fiber suspension is jetted under pressure through the gap between the slice lip and side plates. Rooster tailing of the fiber suspension results in some of the fiber suspension landing on the fiber web which is discharged from the outlet gap of the headbox, thereby deleteriously affecting the quality of the fiber web. Moreover, some of the fiber suspension which is jetted from the gap between the slice lip and the side plates lands on various mechanical components at the outlet side of the headbox and adjacent to the fiber web. Water drains off of the mechanical components and the remaining fibers from the fiber suspension quickly build up on the mechanical components to an undesirable level. Rooster tailing of the fiber suspension from such a large gap between the titanium slice lip and the side plates of the headbox therefore is obviously not a desirable characteristic.

Because of the above-noninclusive technical reasons, titanium slice lips have not been widely used heretofore.

What is needed in the art is a headbox having a titanium slice lip in which the difference in thermal expansion between the titanium slice lip and the steel beam carrying the slice lip does not result in fiber suspension flowing around each end of the slice lip.

SUMMARY OF THE INVENTION

The present invention provides a sealed titanium slice lip assembly which does not allow fiber suspension to pass between the end of the slice lip and the side plate over the range of operating temperatures.

The invention comprises, in one form thereof, a headbox for a paper-making machine including an inlet for receiving a fiber suspension and an outlet for discharging the fiber suspension. The headbox has a plurality of walls including an apron and a pair of side plates. The side plates are disposed at opposite ends of the headbox. The apron is comprised of steel. A beam extends between the side plates and includes opposite ends. Each end is disposed a predetermined distance from a respective side plate when at an ambient temperature (approximately 70° F.). The beam is comprised of steel. A slice lip is carried by the beam. The slice lip is positioned at the outlet and includes a working edge defining an outlet gap with the apron. The slice lip has a pair of longitudinal ends, with each longitudinal end being disposed a predetermined distance from a respective side plate when at the ambient temperature. Each longitudinal end includes a slot extending from and substantially orthogonal to the edge. The slice lip consists essentially of titanium. A pair of seals are disposed in respective ones of the slots and seal between a respective longitudinal end of the slice lip and a respective side plate. Each seal is comprised of a non-woven, porous material.

An advantage of the present invention is that the seals carried by the slice lip avert the problems caused by the difference in thermal expansion between the steel beam and the titanium slice lip by preventing fiber suspension from flowing around the end of the slice lip.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
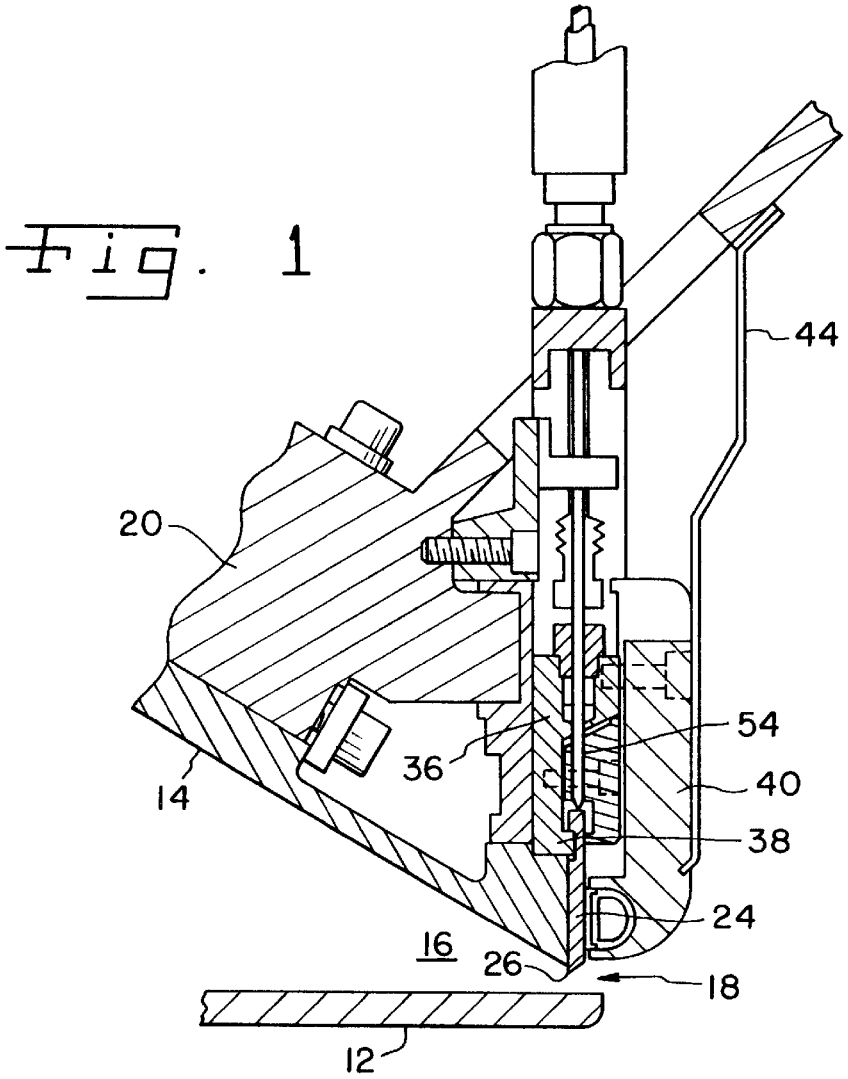
FIG. 1 is a partial side sectional view of an embodiment of a headbox of the present invention.
Figure 2:
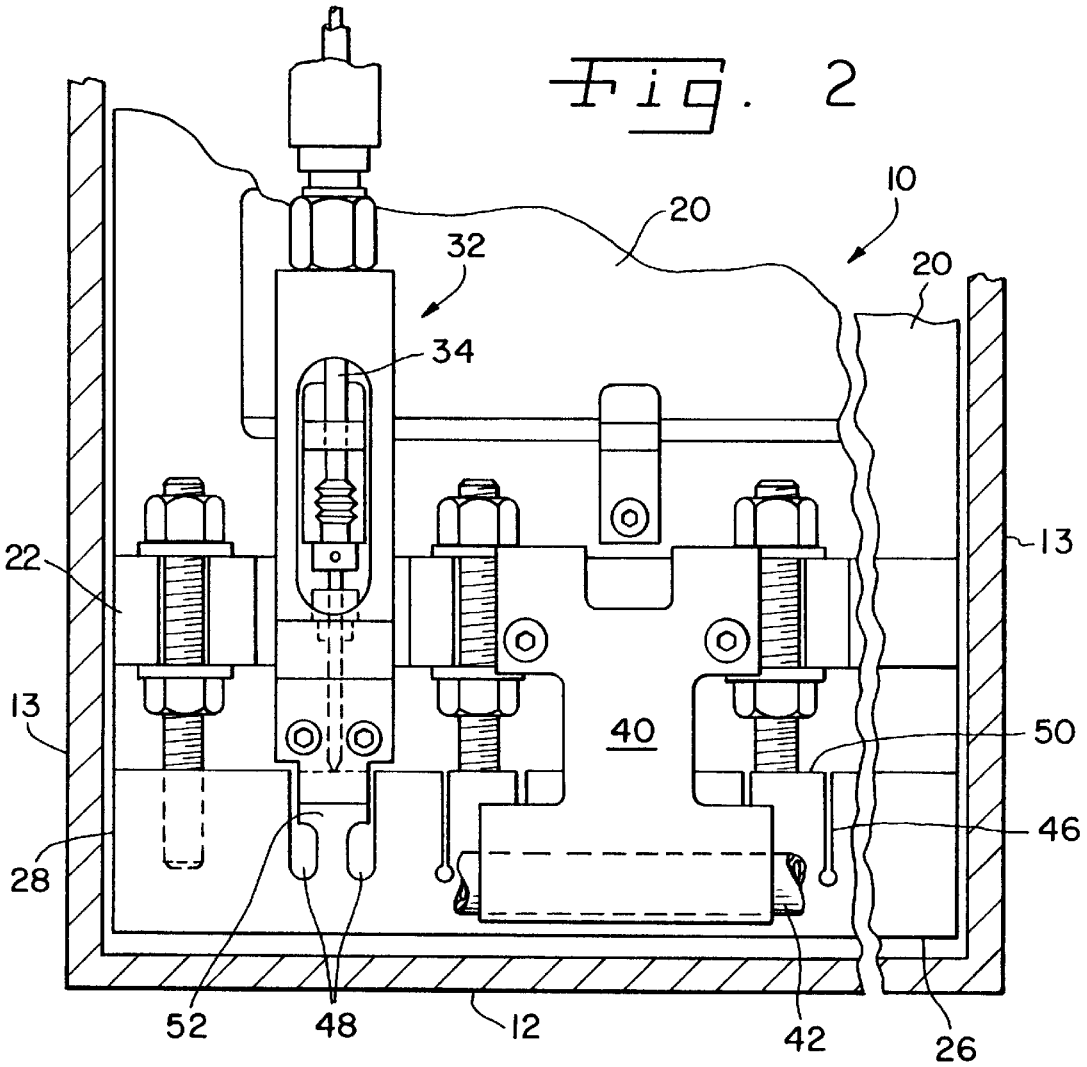
FIG. 2 is a partial front view of the headbox shown in FIG. 1.

Referring now to the drawings, and more particularly to FIGS. 1 and 2, there is shown a portion of a headbox 10 including an inlet (not shown) for receiving a fiber suspension and an outlet defining an outlet gap for discharging the fiber suspension. Headbox 10 has a plurality of walls, including an apron 12 and a pair of side plates 13. Side plates 13 are disposed at opposite ends of headbox 10. Apron 12 and upper flow guide wall 14 converge relative to each other and define a nozzle-type, machine wide stock channel 16 which ends in a machine wide outlet gap 18. The fiber suspension is discharged from outlet gap 18 in known manner onto a wire or forming fabric (not shown). Attached to the opposing ends of beam 20 is a lift device (not shown) for pivotally moving upper flow guide wall 14 relative to apron 12. Upper flow guide wall 14 is thus movable relative to apron 12. Upper flow guide wall 14 is defined by a beam 20 having opposite ends 22 which are disposed a predetermined distance from a respective side plate 13 when headbox 10 is substantially at an ambient temperature (i.e., approximately 70° F.). Beam 20 is formed from steel, preferably grade 316L stainless steel.

Slice lip 24 is carried by beam 20 and is positioned at the outlet of headbox 10. More particularly, slice lip 24 includes a working edge 26 which with apron 12 defines outlet gap 18 extending across the width of headbox 10. Slice lip 24 is formed from titanium, preferably grade 50A titanium. Slice lip 24 has a pair of longitudinal ends 28, with each longitudinal end 28 being disposed a predetermined distance from a respective side plate 13 when at the ambient temperature (i.e., approximately 70° F.). In the embodiment shown, the opposite ends 22 of beam 20 and the opposite longitudinal ends 28 of slice lip 24 are each disposed an equal predetermined distance from respective side plates 13 when at the ambient temperature. In a preferred embodiment, the spacing or gap between each of beam 20 and slice lip 24 when at the ambient temperature is approximately 0.005 inch corresponding to a desired design objective for gaps which is necessary to prevent stringing of the fiber suspension during operation.

Each longitudinal end 28 of slice lip 24 includes a slot 30 which extends from and is substantially orthogonal to edge 26. Slot 30 extends the entire height of slice lip 24 to accommodate a seal to be described hereinafter, and thereby seal between slice lip 24 and a corresponding side plate 13. In the embodiment shown, each slot 30 has a generally rectangular shape, whereby each longitudinal end 28 of slice lip 24 has a substantially U-shaped cross section. The U-shape of each longitudinal end 28 functions to adequately hold an associated seal therein during operation, as will be described in more detail hereinafter.

A plurality of spindle drive assemblies 32 are disposed in spaced apart relationship relative to each other and across the working length of slice lip 24. Spindle drive assemblies 32, one of which is shown in FIGS. 1 and 2, effect the fine adjustment of outlet gap 18. Each spindle drive assembly 32 includes a spindle drive at its upper end (not shown) which rotatably drives an adjustment spindle 34 which is connected with slice lip 24. More particularly, each spindle drive assembly 32 includes a hooked member 36 (FIG. 1) having a portion thereof which is disposed within and engages a slot 38 extending the length of slice lip 24.

A brace plate 40 is bolted to reinforcement beam 20 and carries a pressure hose 42 which forces slice lip 24 against beam 20. A cover 44 (FIG. 1) hermetically seals an interior of beam 20 from the ambient environment. To avoid thermal deformations of upper flow guide wall 14 and beam 20, a liquid may be circulated through internal channels (not shown) formed in beam 20, thereby maintaining beam 20 in a substantially isothermal state.

Slice lip 24 includes a plurality of rectangular openings 46 and maximum relief openings 48. Disposed between rectangular openings 46 are substantially rectangular projections 50. Similarly, disposed between maximum relief openings 48 are T-shaped projections 52. Each of T-shaped projections 52 has an upper surface with a length (in the direction of the length of slice lip 24) allowing interconnection with a respective spindle drive assembly 32. More particularly, hooked member 36 of a spindle drive assembly 32 engages slot 38 in T-shaped projection 52. Movement of hooked member 36 in a direction toward and away from outlet gap 18 in turn moves slice lip 24 in directions toward and away from outlet gap 18 in a locally adjustable manner. A spindle 54 (FIG. 1) engages a top surface of T-shaped projection 52 and detects local deflections of slice lip 24 in directions toward and away from outlet gap 18.

Referring now to FIGS. 3–6, a pair of seals 56 are disposed in a respective slot 30 at each longitudinal end 28 of slice lip 24. Seals 56 extend and seal between a respective longitudinal end 28 of slice lip 24 and a respective side plate 13 of headbox 10. Each seal 56 is comprised of a non-woven, porous material, preferably an open cell polymeric foam material. Seals 56 retain their elasticity properties over a relative large temperature range at least from 60° F. to 160° F. In the embodiment shown, each seal 56 has a substantially T-shaped cross section, with the base of the "T" being received within a slot 30 at an associated longitudinal end 28 of slice lip 24.

Figure 3:
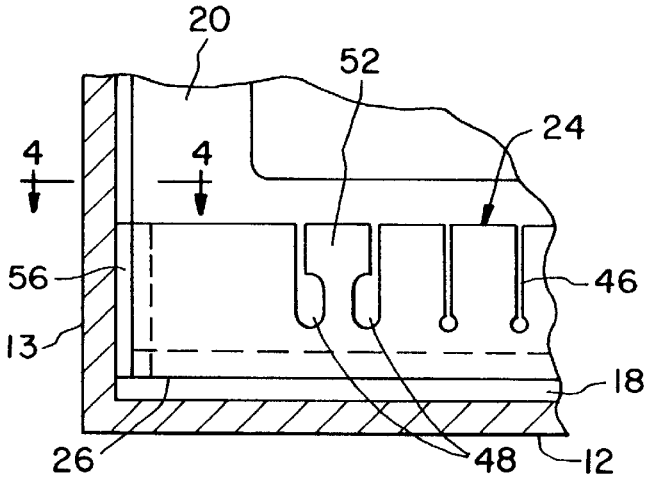
FIG. 3 is an enlarged, partial front view of the side plate, beam and slice lip of FIG. 1 at approximately 70° F.
Figure 4:
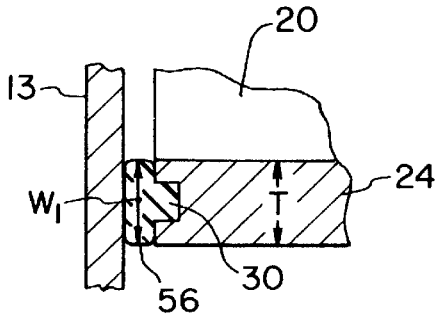
FIG. 4 is a sectional view taken along line 4—4 in FIG. 3.

FIGS. 3 and 4 illustrate the spacial relationship between beam 20, slice lip 24 and a side plate 13 when at an ambient temperature (i.e., approximately 70° F.). When at the ambient temperature, longitudinal ends 28 of slice lip 24 are disposed substantially flush with the ends 22 of beam 20. A gap of approximately 0.005 inch preferably exists between side plate 13 and each of beam 20 and slice lip 24 at approximately 70° F. Each seal 56 is compressed at approximately 70° F. such that the width $W_1$ thereof corresponds approximately to the thickness T of slice lip 24. The open cell and elastic construction of seal 56 allows seal 56 to be compressed without permanent deformation thereof.

Figure 5:
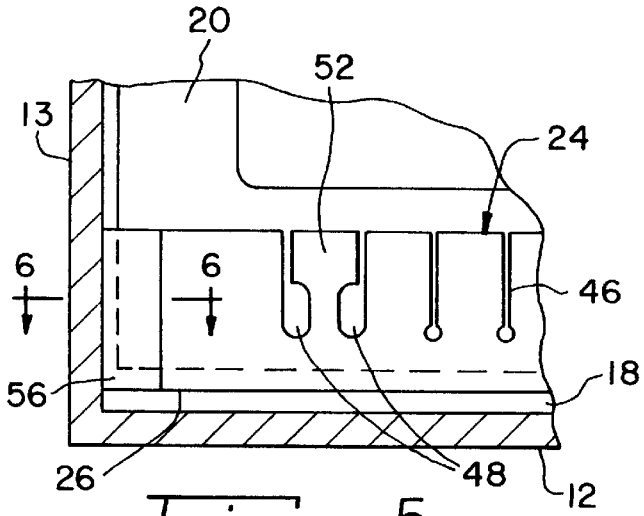
FIG. 5 is an enlarged, partial front view of the side plate, beam and slice lip of FIG. 1 at approximately 160° F.
Figure 6:
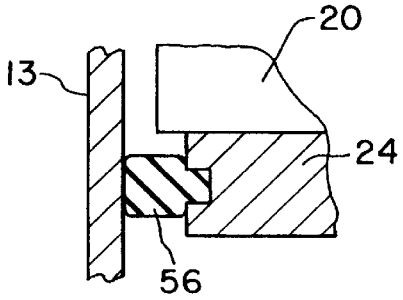
FIG. 6 is a sectional view taken along line 6—6 in FIG. 5.

FIGS. 5 and 6 illustrate the spacial relationships between side plate 13, beam 20 and slice lip 24 at an operating temperature (e.g., 160° F.). Since beam 20 and apron 12 are both formed from stainless steel, the coefficient of thermal expansion is approximately the same for each. Thus, the clearance distance of approximately 0.005 inch is substantially maintained when the temperature of headbox 10 increases from the ambient temperature (i.e., 60–70° F.) to an operating temperature (e.g., 160° F.). On the other hand, slice lip 24 is constructed of titanium which expands at approximately only ½ the rate of stainless steel from which beam 20 and apron 12 are constructed. Thus, an unacceptable gap is formed between longitudinal ends 28 of slice lip 24 and a respective side plate 13. In order to prevent the formation of strings or rooster tailing at the longitudinal ends 28 of slice lip 24, each seal 56 is constructed to accommodate a wide range of gap dimensions. When the large gap between longitudinal ends 28 of slice lip 24 and side plates 13 exists during operation, seals 56 expand to fill the gap, and thereby prevent the formation of strings or rooster tails. FIGS. 5 and 6 show a seal 56 in a more relaxed and only slightly compressed state.

In the embodiment shown in FIGS. 3–6, beam 20 is constructed of stainless steel having a coefficient of thermal expansion of approximately $8.9*10^{-6}$ [in./(in.*°F.)]. Moreover, slice lip 24 is constructed of titanium having a coefficient of thermal expansion of approximately $4.7*10^{-6}$ [in./(in.*°F.)]. Assuming a headbox having an outlet gap with a length across the machine of approximately 400 inches and a temperature increase of approximately 90° F. (i.e., from the ambient temperature of 70° F. to an operating temperature of 160° F.), slice lip 24 has an overall longitudinal expansion of:

$$\frac{4.7*10^{-6}\text{ in.}}{\text{in.}*{}^{\circ}\text{F.}}*400\text{ in.}*90^{\circ}\text{F.}=0.1692\text{ in. total.}$$

This results in a longitudinal expansion at each end of slice lip 24 of approximately 0.0846 inch (0.1692/2).

Similarly, steel beam 20 has an overall longitudinal expansion of:

$$\frac{8.9*10^{-6}\text{ in.}}{\text{in.}*{}^{\circ}\text{F.}}*400\text{ in.}*90^{\circ}\text{F.}=0.3204\text{ in. total.}$$

This results in a longitudinal expansion at each end of beam 20 of approximately 0.1602 inch (0.3204/2). Subtracting the difference in expansion per end yields 0.1602–0.0846 or 0.0756 inch per end difference in expansion between steel beam 20 and titanium slice lip 24. Adding in the already existent gap of 0.005 inch results in a total gap at each end of slice lip 24 and an associated side plate 13 of approximately 0.080 inch. This is approximately 0.075 inch greater than the desired maximum design objective of a 0.005 inch gap. With such large gaps, as described above, strings and rooster tails would normally occur at each longitudinal end 28 of slice lip 24. However, the provision of slots 30 at each end of slice lip 24 and the use of a compressible, porous seal allows gaps varying over a wide temperature range between ends 28 of slice lip 24 and side plates 13 to be effectively sealed.

In the embodiment shown, each longitudinal end 28 of slice lip 24 has a substantially U-shaped cross section, including an associated rectangular slot 30. Moreover, each seal 56 is shown with a substantially T-shaped cross section which is matingly connected with a longitudinal end 28 of slice lip 24. However, it is also to be understood that slots 30 may have a different cross sectional profile or be placed at a different location at the longitudinal end 28 of slice lip 24. Of course, seals 56 would likewise need to be formed with at least a portion thereof having a cross sectional profile which mates with the particularly configured slot in the longitudinal end 28 of slice lip 24. The important design criteria is that the slot must be configured to adequately retain the seal at the longitudinal end 28, and the seal must be configured with an elastic and porous construction to accommodate gaps varying over a large range.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A headbox for a paper-making machine, said headbox including an inlet for receiving a fiber suspension and an outlet for discharging the fiber suspension, said headbox comprising:

a plurality of walls including an apron and a pair of side plates, said side plates disposed at opposite ends of said headbox, said apron comprised of steel;

a beam extending between said side plates and including opposite ends, each said end disposed a predetermined distance from a respective said side plate when at an ambient temperature, said beam comprised of steel;

a slice lip carried by said beam, said slice lip positioned at said outlet and including a working edge defining an outlet gap with said apron, said slice lip having a height extending substantially orthogonal to said working edge, said slice lip having a pair of longitudinal ends, each said longitudinal end disposed a predetermined distance from a respective said side plate when at the ambient temperature, each said longitudinal end including a slot extending from and substantially orthogonal to said working edge, said slice lip consisting essentially of titanium; and a pair of seals, each said seal being disposed in a respective one of said slots and extending substantially across said height of said slice lip, each said seal sealing between a respective said longitudinal end of said slice lip and a respective said side plate along said height of said slice lip, each said seal comprised of a non-woven, porous material.

2. The headbox of claim 1, wherein said beam consists essentially of stainless steel.

3. The headbox of claim 2, wherein said beam consists essentially of grade 316L stainless steel.

4. The headbox of claim 2, wherein said beam has a coefficient of thermal expansion of approximately $8.9*10^{-6}$ (in./[in.*°F.]).

5. The headbox of claim 4, wherein said slice lip has a coefficient of thermal expansion of approximately $4.7*10^{-6}$ (in./[in.*°F.]).

6. The headbox of claim 2, wherein said apron consists essentially of stainless steel.

7. The headbox of claim 1, wherein said slice lip has a coefficient of thermal expansion of approximately $4.7*10^{-6}$ (in./[in.*°F.]).

8. The headbox of claim 1, wherein said slice lip consists essentially of grade 50A titanium.

9. The headbox of claim 1, wherein each said seal is comprised of an open cell foam.

10. The headbox of claim 9, wherein each said seal is comprised of an open cell polymeric foam.

11. The headbox of claim 1, wherein each said seal retains associated elasticity properties over a temperature range of between approximately 60° F. and 160° F.

12. The headbox of claim 1, wherein each said longitudinal end of said slice lip is substantially flush with each respective said end of said beam at the ambient temperature.

13. A headbox for a paper-making machine, said headbox including an inlet for receiving a fiber suspension and an outlet for discharging the fiber suspension, said headbox comprising:

a plurality of walls including an apron and a pair of side plates, said side plates disposed at opposite ends of said headbox, said apron comprised of steel;

a beam extending between said side plates and including opposite ends, each said end disposed a predetermined distance from a respective said side plate when at an ambient temperature, said beam comprised of steel;

a slice lip carried by said beam, said slice lip positioned at said outlet and including a working edge defining an outlet gap with said apron, said slice lip having a pair of longitudinal ends, each said longitudinal end disposed a predetermined distance from a respective said side plate when at the ambient temperature, each said longitudinal end including a slot extending from and substantially orthogonal to said working edge, each said end of said slice lip having a substantially U-shaped cross section when viewed in a direction substantially orthogonal to said apron, said slice lip consisting essentially of titanium; and a pair of seals, each said seal being disposed in a respective one of said slots and sealing between a respective said longitudinal end of said slice lip and a respective said side plate, each said seal having a substantially T-shaped cross section when viewed in a direction substantially orthogonal to said apron, each said seal comprised of a non-woven, porous material.

14. A headbox for a paper-making machine, said headbox including an inlet for receiving a fiber suspension and an outlet for discharging the fiber suspension, said headbox comprising:

a plurality of walls including an apron and a pair of side plates, said side plates disposed at opposite ends of said headbox, said apron comprised of steel;

a beam extending between said side plates and including opposite ends, each said end disposed a predetermined distance from a respective said side plate when at an ambient temperature, said beam comprised of steel;

a slice lip carried by said beam, said slice lip positioned at said outlet and including a working edge defining an outlet gap with said apron, said slice lip having a height extending substantially orthogonal to said working edge, said slice lip having a pair of longitudinal ends, each said longitudinal end disposed a predetermined distance from a respective said side plate when at the ambient temperature, each said longitudinal end including a slot extending from and substantially orthogonal to said working edge, said slice lip consisting essentially of titanium; and a pair of seals, each said seal being disposed in a respective one of said slots and extending substantially across said height of said slice lip, each said seal sealing between a respective said longitudinal end of said slice lip and a respective said side plate along said height of said slice lip, said sealing being over a temperature range of approximately 60° F. to 160° F., each said seal comprised of a non-woven, porous material.

* * * * *

UNITED STATES PATENT AND TRADEMARK OFFICE

CERTIFICATE OF CORRECTION

PATENT NO. : 5,853,546

DATED : December 29, 1998

INVENTOR(S) : Edwin X. Graf

It is certified that error appears in the above-identified patent and that said Letters Patent is hereby corrected as shown below:

Column 1

Line 42, after "gap" insert --of no more than 0.005 inch between the various parts within the-- therefore.

Signed and Sealed this

Tenth Day of August, 1999

*Attest:*

Q. TODD DICKINSON

*Attesting Officer*

*Acting Commissioner of Patents and Trademarks*